United States Patent [19]

Goodhouse

[11] 4,056,948

[45] Nov. 8, 1977

[54] PRESETTABLE DEFROST TIMER

[75] Inventor: Carl J. Goodhouse, Litchfield, Conn.

[73] Assignee: Robertshaw Controls Company, Richmond, Va.

[21] Appl. No.: 700,984

[22] Filed: June 29, 1976

[51] Int. Cl.[2] ..... F25D 21/08

[52] U.S. Cl. ..... 62/155; 62/176 A; 200/38 FB

[58] Field of Search ..... 62/176 A, 155, 80, 234; 200/38 FB; 307/141

[56] References Cited

U.S. PATENT DOCUMENTS

| | | | |
|---|---|---|---|
| 3,277,662 | 10/1966 | Winters | 62/155 |
| 3,460,352 | 8/1969 | Lorenz | 62/153 |
| 3,518,841 | 7/1970 | West, Jr. | 62/153 |

*Primary Examiner*—William E. Wayner

*Attorney, Agent, or Firm*—Harold W. Adams; Auzville Jackson, Jr.

[57] ABSTRACT

An automatic defrost timing circuit includes facilities for selectively varying the compressor running time between defrost cycles to allow the circuit to be set in accordance with varying factors such as a humid or a dry climate.

6 Claims, 2 Drawing Figures

FIG. 1
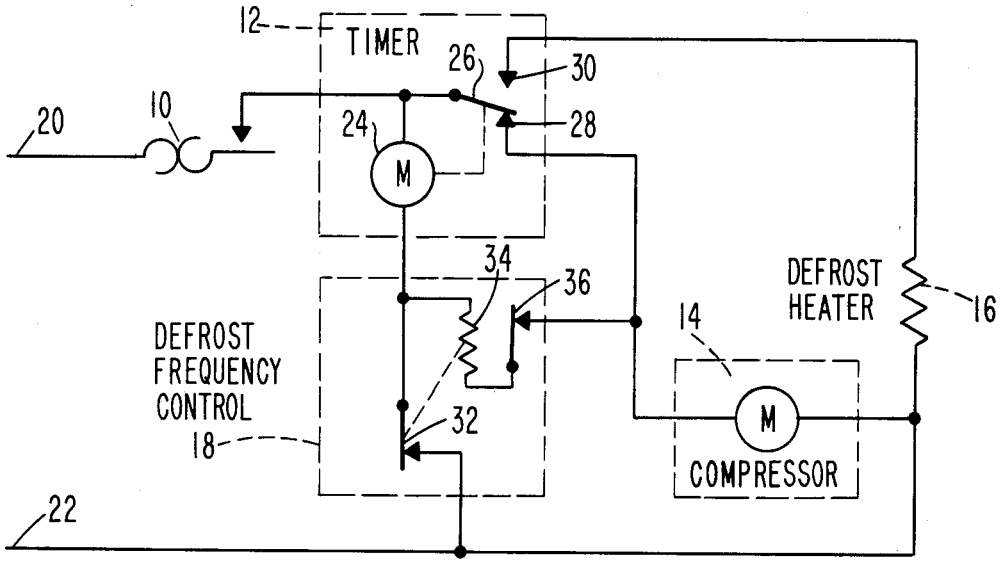
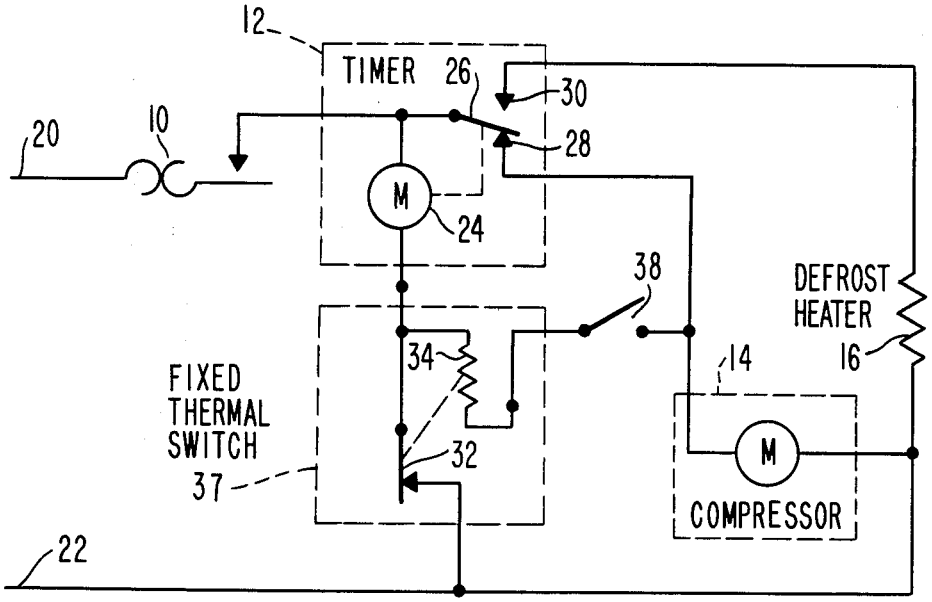
FIG. 2

PRESETTABLE DEFROST TIMER

BACKGROUND OF THE INVENTION

This invention relates to automatic defrost timing circuits for refrigeration equipment such as refrigerators. In such equipment, a compressor controlled by a thermostat responsive to the temperature in a refrigerated enclosure pumps a refrigerant into condenser coils where the refrigerant is condensed giving off heat, and then the condensed refrigerant is expanded in evaporator or cooling coils absorbing heat and lowering the temperature within the refrigerated space; a defrost heater associated with the cooling coils is automatically cycled with the operation of the equipment by a defrost timer to melt ice formed on the cooling coils from humidity in the air within the refrigerated space.

SUMMARY OF THE INVENTION

The invention is summarized in a defrost timing circuit including a refrigeration compressor, a defrost heater, thermostatic means responsive to temperature in a refrigerated enclosure, defrost timing means responsive to the thermostat means and including switch means connected to the compressor and defrost heater for providing a first period of operation of the compressor and a second period of operation of the defrost heater after the first period, and means for selectively changing the first period of operation of the defrost timing means.

An object of the invention is to construct a defrost timing circuit wherein the frequency of the defrost cycle, or the accumulated compressor running time between defrost cycles, can be selected in accordance with varying factors such as humidity.

Another object of the invention is to provide a relatively simple and inexpensive variable defrost timing circuit employing a conventional defrost timing unit.

It is still another object of the invention to maintain the same length of defrost period regardless of the setting of the duration between defrost periods.

An advantage of the invention is that the operation of the defrost heater can be selectively made less frequent in low humidity or a dry climate thus conserving energy.

In another feature of the invention a selectable timing unit operated simultaneously with the compressor interrupts a portion of the accumulation of compressor time in the defrost timing unit to thus add a selected duration to the period of compressor operation between defrost periods.

Other objects, advantages and features of the invention will be apparent from the following description of the preferred embodiments taken in conjunction with the accompanying drawings.

BRIEF DESCRIPTION OF THE DRAWINGS

FIG. 1 is an electrical schematic of a presettable defrost timing circuit in accordance with the invention.

FIG. 2 is an electrical schematic of a modified presettable defrost timing circuit in accordance with the invention.

DESCRIPTION OF THE PREFERRED EMBODIMENT

As illustrated in FIG. 1, the invention is embodied in a variable defrost timing circuit for refrigeration equipment such as refrigerators and the like. The circuit includes a thermostatic switch 10, a timer circuit 12, a refrigeration compressor 14, a defrost heater 16, and a defrost frequency control 18 connected to electrical power terminals 20 and 22.

The thermostatic switch 10 is a conventional temperature responsive switch which closes when the temperature within a refrigerated enclosure goes above a selected temperature or range of temperatures and which opens when the temperature within the enclosure goes below the selected temperature or range.

The timer unit 12 includes cylcing means such as a timer motor 24 connected in series with the thermostatic switch 10 and the defrost frequency control 18 across the power terminals 20 and 22. A single-pole double-throw (SPDT) switch has a contact arm 26 operable by the timer motor 24 and connected through the thermostatic switch to the power terminal 20. One terminal of the motor in the compressor 14 is connected to a first or normally closed contact 28 of the SPDT switch while the other compressor motor terminal is connected to the power terminal 22. The second or normally open contact 30 of the SPDT timer switch is connected to one side of the heater 16 which has its other side joined to the terminal 22. The contact arm opening means, such as a cam driven by the timer motor 24, of timer unit 12 is such that the contact arm 26 engages the contact 28 during a first selected period of operation of the timer motor 24 and the contact arm 26 engages the contact 30 during a second selected period of operation of the timer motor 24; the first period is selected to allow only a predetermined amount of ice accumulation on the refrigerator cooling coils in relative severe conditions, such as high humidity and the second period is selected to provide for sufficient heater operation to melt the accumulated ice.

The refrigeration compressor 14 and the defrost heater 16 are conventional items normally employed on self-defrosting refrigeration equipment.

In the defrost frequency control unit 18, a control switch such as a pair of normally closed contacts 32 is connected in series with the timer motor 24 and the terminal 22. Delay means, such as a conventional heat motor including a heater 34, for operating (for example-opening) the contacts 32 is connected on one side by an ON-OFF switch 36 of the unit 18 to the contact 28, and on the other side, by contacts 32 to the terminal 22 in parallel with the compressor 14. The heat motor 34 for operating the contacts 32 is selected to open the contacts 32 after a predetermined continuous duration of energization of the heat motor through thermostatic switch 10 and contact 28; such predetermined duration being substantially less then a normal continuous operating period of the compressor 14 during one period of closure of the thermostatic switch 10 and one period of engagement of the contact arm 26 with the contact 28. Further the heat motor 34 is selected to provide an open time of the switch 32, through either one cycle or the accumulation of a plurality of complete cycles of the unit 18, corresponding to a preset additional duration or period to be added to the first period of the timer 12 when the contact arm 26 engages the contact 28.

In operation of the presettable refrigerator timing circuit, the on-off switch 36 is selectively closed when factors, such as low humidity, permit a substantially lesser defrosting frequency of the refrigerator cooling or evaporating coils than is necessary in the presence of more severe conditions such as high humidity. The defrost frequency control, when the switch 36 is "on", i.e. closed, changes the operation of the defrost timer 12 to increase the period of operation of the defrost timer 12 between defrost periods.

More particularly when the thermostatic switch 10 is closed, the timer motor 24 advances to cycle the contact arm 26 between contacts 28 and 30 and alternately energize the refrigeration compressor 14 and the defrost heater 16, respectively; operation of the compressor 14 results in additional cooling of the refrigerated enclosure, and operation of the defrost heater results in removal of ice from the evaporation coils. Engagement of the contact arm 26 with contact 28 when the thermostatic switch 10 is closed also energizes the heater 34 of the heat motor in the defrost frequency control means 18. After a delay the heat motor opens the switch 32 interrupting the current through timing motor 24 and preventing advancement of the timing motor 24 while the switch 32 is open. Also the opening of switch 32 interrupts current through the heater 34 allowing the heater to cool causing the contacts 32 to reclose after a further delay. There is at least one complete cycle of the heat motor and contacts 32, and there may be several complete cycles of the heat motor and contacts 32 during each period of energization of the compressor 14. The cumulative duration that the contacts 32 are open during one period of time when the contact arm 26 engages the contact 28 is thus added to the normal period of time of the timer 12 between successive defrost periods.

Under conditions such as humid climates, the switch on-off switch 36 is "off" i.e. open, thus allowing the timer 12 to function normally and to provide a shorter accumulated compressor running time period between defrost periods.

The incorporation of the defrost frequency control 18 in the timing circuit provides for less use of the defrost heater, when conditions permit, and thus a saving in expense of operation of the refrigeration equipment. Also, the particularly described heat motor operated switch provides a relatively inexpensive addition to the timing circuit to produce the savings in operating expense.

It is noted that connection of the heat motor 34 and the on-off switch 36 between the contact 28 and the contacts 32 results in several cycles of the control 18 at least during a long operating time of the compressor 14; thus the additional duration added to the accumulated compressor time due to opening of the switch 32 remains generally the same for a cycle of the timer 12 regardless of whether one or more operating periods of the compressor in that cycle of the timer were longer than normal.

The modified defrost timing circuit shown in FIG. 2 includes a fixed thermal unit 37 in place of the variable thermal unit 18 in the circuit of FIG. 1; i.e., the unit 37 does not include an on-off switch. Instead an on-off switch 38 in FIG. 2 is in a separate unit, the switch 38 however connected electrically in the same manner and having the same function of the switch 36 of FIG. 1. Further the fixed thermal unit 37 contains heat motor 34 and contacts 32 connected and functioning with the timer 12 in the same manner as previously described.

Since many modifications, changes in detail and variations of the disclosed presettable refrigerator timer can be made, it is intended that all matter in the foregoing description and shown in the accompanying drawings be interpreted as illustrative and not in a limiting sense.

What is claimed is:

1. A defrost timing circuit comprising:

a compressure for refrigerating enclosures;

a defrost heater;

thermostat means responsive to the temperature in said refrigerated enclosures;

defrost timing means responsive to said thermostat means, said defrost timing means including a timing motor means, and a switch means operated by said timing motor means connected to said compressor and said defrost heater, said defrost timing means providing a first normal period of operation of said compressor and a second period of operation of said defrost heater after said first normal period of operation of said compressor;

means for selectively changing said first normal period of operation of said compressor, said selectively changing means including a normally closed control switch in series with said timing motor means, said selectively changing means further including a heat motor delay means connected and parallel with said compressor for opening said normally closed control switch after the selected duration of operation for said compressor, said selected duration being substantially less in time than said first normal period of operation of said compressor.

2. A defrost timing circuit as claimed in claim 1 wherein the changing means further includes an on-off switch connected in series with the heat motor.

3. A defrost timing circuit as claimed in claim 2 wherein the on-off switch, the control switch and the heat motor are together in a variable thermal unit.

4. A defrost timing circuit as claimed in claim 2 wherein the control switch and heat motor are together in a fixed thermal unit and the on-off switch is in a separate unit from the fixed thermal unit.

5. A defrost timing circuit comprising a refrigeration compressor;

a defrost heater;

a thermostatic switch responsive to temperature in a refrigerated enclosure;

defrost timing means including defrost timing motor means connected in series with the thermostatic switch;

said defrost timing means also including a single pole double-throw switch with a contact arm connected in series with the thermostatic switch and operated by the defrost timing motor means and with first and second contacts alternately engaged by the contact arm, said first contact connected to the compressor and engaged by the contact arm during a first period of operation of the motor means and the said second contact connected to the defrost heater and engaged by the contact arm during a second period of operation of the timing motor means, defrost frequency control means including a normally closed control switch in series with the defrost timing motor means and including heat motor means having a control heater, said heat motor means such that the control switch is opened after a duration of energization of the control heater, said duration being substantially less than a normal operating period of the compressor; and said defrost frequency control means also including an on-off switch connected in series with the first contact of the single-pole double-throw switch and the control heater for selectively changing the time of operation of the compressor between successive operations of the defrost heater.

6. A defrost timing circuit as claimed in claim 5 wherein the on-off switch and the control heater are also connected in series with the control switch.

* * * * *